US008146500B2

(12) United States Patent
Frieden

(10) Patent No.: US 8,146,500 B2
(45) Date of Patent: Apr. 3, 2012

(54) MULTIFUNCTIONAL DETONATION SYSTEM

(75) Inventor: Ernest Frieden, Langnau am Albis (CH)

(73) Assignee: Recconn AG, Langnau am Albis (CH)

( * ) Notice: Subject to any disclaimer, the term of this patent is extended or adjusted under 35 U.S.C. 154(b) by 301 days.

(21) Appl. No.: 12/097,032

(22) PCT Filed: Dec. 6, 2006

(86) PCT No.: PCT/EP2006/011711

§ 371 (c)(1),
(2), (4) Date: Sep. 3, 2008

(87) PCT Pub. No.: WO2007/068386

PCT Pub. Date: Jun. 21, 2007

(65) Prior Publication Data

US 2009/0000504 A1 Jan. 1, 2009

(30) Foreign Application Priority Data

Dec. 12, 2005 (EP) ..... 05027055

(51) Int. Cl.
*F42B 3/02* (2006.01)

(52) U.S. Cl. ..... 102/320; 102/331; 102/332

(58) Field of Classification Search ..... 102/301, 102/302, 314, 320, 322, 331, 332
See application file for complete search history.

(56) References Cited

U.S. PATENT DOCUMENTS

| | | | | |
|---|---|---|---|---|
| 2,087,209 | A * | 7/1937 | Lahey et al. | 383/83 |
| 2,635,543 | A * | 4/1953 | Sillitto et al. | 102/316 |
| 2,682,220 | A * | 6/1954 | Hagensen | 102/321 |
| 2,916,992 | A * | 12/1959 | Welsh, Jr. | 102/313 |
| 2,982,209 | A * | 5/1961 | Borcher | 102/332 |
| 3,477,373 | A | 11/1969 | Falterman et al. | |
| 3,720,166 | A * | 3/1973 | Sewell et al. | 102/302 |

FOREIGN PATENT DOCUMENTS

| | | |
|---|---|---|
| AT | 383 890 | 9/1987 |
| DE | 22 16 150 | 11/1972 |
| FR | 2 558 949 | 8/1985 |

OTHER PUBLICATIONS

International Search Report of International Application No. PCT/EP2006/011711, mailed on Apr. 11, 2007.

* cited by examiner

*Primary Examiner* — James Bergin
(74) *Attorney, Agent, or Firm* — Hershkovitz & Associates, LLC; Abraham Hershkovitz

(57) ABSTRACT

Explosive apparatus has at least two cuboid moldings, which each includes at least one firing hole and explosive, and whose edge lengths have a ratio of substantially 1:2:4, and a container including an internal area having a square outline and at least one aperture hole to the internal area, the internal area having a side length corresponding at least approximately to a longest edge length of the moldings and a height corresponding at least approximately to a shortest edge length of the moldings or to an integer multiple thereof, wherein the moldings are placed in the internal area of the container such that the at least one firing hole in one of the at least two moldings is aligned with the at least one aperture hole in the container, the aperture hole being intended for insertion of an explosive capsule into the firing hole of the corresponding molding.

19 Claims, 10 Drawing Sheets

MULTIFUNCTIONAL DETONATION SYSTEM

BACKGROUND OF THE INVENTION

1. Field of the Invention

The present invention relates to an explosive apparatus, and to a container and a molding therefor.

2. Discussion of Related Art

Explosive apparatuses can be roughly subdivided into two types. On the one hand, those explosive apparatuses which are intended for a very specific purpose and are also suitable only for this purpose. On the other hand, those explosive apparatuses which are intended to be widely used and must therefore be matched to the specific circumstances for the specific application. The latter in particular are subject to various disadvantages, in particular relating to achievement of the desired explosive effect.

Examples of explosive apparatuses having a specific purpose are shaped charges and directional charges.

Shaped charges comprise a so-called hollow charge which allows the explosive hole that is required for the actual explosive charge to be prepared in the background. This cylindrical explosive hole is then provided with the actual explosive charge, and is caused to detonate. Shaped charges are intended to rapidly create obstructions in a terrain.

Directional charges are explosive apparatuses which allow directional detonation of fragmentation charges. In order to achieve this, a layer of explosive is applied, for example, to a steel plate, and a further layer, for example composed of plastic, with embedded steel fragments or spheres is applied to this layer. The detonation results in the steel fragments being fired directionally. The charge intensity of the directional charge is generally fixed in advance, and cannot be varied.

Improvised explosive charges must be used for purposes for which no specialized explosive apparatuses are available, for example such as those mentioned above. This is very often the case in the military field. In this case, for example, explosives such as trinitrotoluene or Plastit are used, for example, in different amounts depending on the situation and the intended target. Trinitrotoluene is a solid explosive while, in contrast, Plastit can be deformed within certain limits, which also depend on the environmental temperature. In general, the explosive charge will therefore be composed of a plurality of explosive bodies. This can be accomplished, for example, by securing the required amount of trinitrotoluene on a board by means of adhesive tape and then causing it to detonate by means of a fuze. However, this obviously has a number of associated disadvantages. The explosive apparatus must be assembled in situ, which is difficult. Since this is often subject to time pressures, this procedure is highly susceptible to errors. For example, the entire explosive charge may not detonate because the individual explosive bodies (composed of trinitrotoluene for example) have not been attached sufficiently closely and firmly to one another. In consequence, the desired explosive effect is achieved only inadequately, or not at all.

In the case of improvised explosive charges, the unprotected fuze is often also damaged, thus in the end rendering the entire explosive apparatus unusable.

SUMMARY OF THE INVENTION

The object of the present invention is to provide an explosive apparatus which can be handled easily, can be used in a very short time, whose strength can be adapted and which ensures reliable detonation of the entire explosive charge. The aim is for it to be possible to use the explosive apparatus both in the open air and in buildings.

The object is achieved by an explosive apparatus which has the features specified in claim 1. Further preferred embodiments are the subject matter of the dependent claims.

An explosive apparatus according to the invention has the features according to claim 1. A predetermined ratio of the edge lengths of one of the cuboid moldings containing explosive of 1:2:4 and the dimensions, which depend on this, of an internal area of a container mean that the moldings can be arranged in the container such that they fit accurately. The internal area of the container has a square outline, with a side length corresponding to the longest edge length of the molding. If the height of the internal area corresponds to the shortest edge length of a molding, two of the moldings can be placed in this internal area. In this case, they may be arranged either longitudinally or transversely. If the height of the internal area corresponds to twice the shortest edge length of the molding, four moldings can be placed in the internal area of the container. The moldings can be placed alongside one another upright, or two moldings can be arranged alongside one another, with the other two moldings on them. This positioning may be either longitudinal or else lateral. If the height of the internal area corresponds to four times the shortest edge length of the molding, eight moldings are located in the internal area. These may comprise in each case two moldings alongside one another in four layers, in each case four moldings alongside one another in two layers, or all eight moldings upright alongside one another on their smallest side. These various arrangement options can be used without calling the functionality of the explosive apparatus into question, for example because all the firing holes in the moldings are inaccessible.

The accurately fitting, close arrangement of the moldings composed of explosive in the container ensures reliable detonation transmission. The explosive is generally initiated by means of an explosive capsule, such as those normally used for initial firing of explosive. The explosive capsule can for this purpose be inserted into the firing hole in one of the moldings through an aperture hole, which is aligned with a firing hole in the molding, towards the internal area of the container. If the dimensions of the internal area match only approximately, filler is arranged in the remaining area in order to achieve a close arrangement of the moldings containing the explosive with respect to one another, therefore ensuring transmission of the detonation.

The container is used on the one hand for storage and transportation of the explosive moldings, but on the other hand is a component of the explosive apparatus at the same time. The container may be composed of wood, metal or plastic. The detonation effect can be influenced specifically by the choice of the material and of the wall thickness. Directional charges can be produced by using walls of different material, for example by using metal for one side wall while the other walls are composed of wood.

The storage characteristics of the explosive apparatus can additionally be improved by packing it in shrink film.

In one preferred embodiment according to Claim 2, the aperture hole to the internal area of the container is arranged in a bottom wall of the container. This offers a particularly wide range of options for arrangement of the aperture hole.

In a further preferred embodiment according to Claim 3, in addition to having the internal area, the container has a service area which is separated from the internal area by an intermediate wall. The service area is used to hold accessories, for example tools, detonation cords, explosive capsules and various inserts such as fragmentation or incendiary inserts, etc.

All of the accessories for the explosive apparatus can therefore be stored and transported with it, and are all available at the point of use.

In one preferred embodiment according to Claim 4, the intermediate wall and a side wall, which bounds the service area, of the container each also have at least one aperture hole. This makes it possible to insert the explosive capsule into the firing hole in one of the moldings from the service area of the container. The detonation cord is then passed into free space through the aperture hole in the side wall which bounds the service area. This results in the firing apparatus being protected very well against environmental influences. The explosive apparatus according to the invention can therefore be buried without any problems, and will not be damaged even if vehicles drive over it.

In a further preferred embodiment according to Claim 5, the container has a plurality of aperture holes. In this embodiment, a plurality of explosive capsules can be used to fire the explosive moldings. Depending on which of the available aperture holes which are aligned with a firing hole in one of the moldings will be used for firing, it is therefore possible to influence the nature of the detonation.

In one preferred embodiment according to Claim 6, the aperture holes are sealed. The closure elements protect the explosive moldings in the internal area against environmental influences, in particular against moisture. A very wide range of different types of closure elements can be used, for example with the aperture holes being sealed by means of an adhesive strip. This adhesive strip can be removed very easily and quickly in use. It is also possible to use appropriate inserts, for example pins, which can be removed from the relevant aperture hole by slight pressure.

In one particularly preferred embodiment according to Claim 7, the closure elements are incorporated in the walls of the container. They are a component of the wall and can easily be pushed out of the wall when required, via a weak point. This has the advantage that there is no need for special closure elements, for example pins or the like. Separate closure elements may be lost during transportation or, in order to prevent this, must be secured in a complex form.

The weak points may be provided in different ways. For example, the aperture holes provided may be provided by perforation of the wall. Another possibility is to provide a non-continuous annular gap or a blind hole. If a specific aperture hole is now required, the wall piece which has already largely been cut out can be cut out completely by a relatively small amount of pressure.

In one preferred embodiment of the explosive apparatus according to Claim 8, the container is designed in a modular form. The combination of a basic module with one or more additional modules allows different explosive charge intensities to be produced in a very simple manner. The height of a basic module and/or of an additional module corresponds to the shortest edge length, or to twice the shortest edge length, of the molding. By way of example, two explosive moldings are used in the basic module, four are used with one additional module, and six or eight, respectively, are used with one or two further additional module or modules. The explosive charge intensity can therefore be matched very accurately to the respective purpose. For example, when using eight moldings, it is also possible to plug two basic modules to one another without cover walls, whose height corresponds to twice the shortest edge length of the molding, and with the internal areas pointing towards one another. The fastening between the two basic modules is achieved by using tapes, clips, screws or other known means.

In a further preferred embodiment according to Claim 9, the moldings have a plurality of firing holes. On the one hand, this allows the moldings to be arranged in a different manner in the internal area of the container. On the other hand, a plurality of firing holes can be used to fire the same molding. This in turn makes it possible to influence the form (for example the direction) of the detonation.

In one particularly preferred embodiment according to Claim 10, the moldings have a different number of firing holes on the three parallel side pairs.

One firing hole is arranged on the two parallel sides with the edge length ratio 1:2 and is preferably located precisely at the centre point of the sides. Two firing holes are located on each of the two parallel sides with the edge length ratio 1:4. On these two sides, the firing holes are preferably arranged at a distance which corresponds to the shortest edge length of the molding from the shorter edge on that side, and at a distance which corresponds to half the shortest edge length of the molding, from the longer edge of that side. Four firing holes are arranged on each of the two parallel sides with the edge length ratio 2:4, and these firing holes pass all the way through. On these two sides as well, the firing holes are preferably arranged at a distance which corresponds to the shortest edge length of the molding from the shorter edge on that side, and at a distance which corresponds to half the shortest edge length of the molding, from the longer edge of that side. The firing holes in the other two parallel side pairs do not necessarily pass all the way through, and they need only have a depth which allows accommodation of conventional explosive capsules or other firing means.

In this embodiment, each of the sides of the molding can be used to initiate the detonation, therefore greatly simplifying the arrangement of the moldings in the internal area of the container, in particular, and the handling of the explosive apparatus in general.

In one preferred embodiment according to Claim 11, the moldings have a depression in the form of a groove on at least one side, in order to hold an insert. The depression in the form of a groove may have a cross section which is either approximately semicircular or rectangular. A rectangular shape is preferable, however, since this shape results in appropriately shaped inserts making flush contact with the side of the molding without any remaining free space. It is particularly preferable for the depression in the form of a groove to have a square cross section.

The inserts may be composed of a very wide range of materials. Inserts composed of metal allow the moldings to be provided with fragments in a simple manner. Highly suitable metals are iron and tungsten.

In one particularly preferred embodiment according to Claim 12, the moldings have a plurality of depressions which are in the form of grooves and run parallel to edges of the molding. The provision of a plurality of depressions which are in the form of grooves allows the use of grid-like inserts.

In a further preferred embodiment according to Claim 13, the three parallel side pairs of the moldings each have a different color, for example green, blue and brown. It is advantageous to choose colors which can be distinguished easily. The different colors make it simple to check whether the moldings are arranged correctly in the internal area of the container, since only one color should in each case be visible once all the moldings have been inserted. This simple check ensures that the moldings are arranged correctly, therefore simplifying the handling of the explosive apparatus.

In a further preferred embodiment according to Claim 14, the container has attachment means which allow the attachment of a telescopic support, preferably with a jointed head.

The attachment means are preferably arranged on the bottom wall of the container. The telescopic support allows the explosive apparatus to be used above the floor or ground, for example on walls, pillars or under the ceiling in buildings. The telescopic support can be extended, and its length can therefore be matched to the circumstances. The moving jointed head allows the telescopic support to be positioned at an angle, therefore allowing the explosive apparatus to be fitted to a wall at the desired height. The extended telescopic support, arranged at an angle, is for this purpose wedged against a suitable resistance, for example, the opposite wall. The explosive apparatus is wedged on the wall by its own weight.

An insert according to Claim 15 allows the moldings to have additional functions, for example by the use of fragmentation or incendiary inserts. This greatly extends the field of use of the explosive apparatus according to the invention. In addition to the removal of obstructions and rendering the traffic infrastructure unusable specifically in the military field, it is also suitable for further purposes.

In one preferred embodiment according to Claim 16, the insert contains metal or incendiary means. Suitable and preferred metals are iron or tungsten, although other metals can also be used. It is also possible to influence the size of the fragments by means of appropriate weak points in the metal insert. One preferred example for an incendiary means is aluminium powder. If there is no intention of using fragmentation or incendiary inserts, it is possible to fill the depressions in the form of grooves with appropriate inserts composed of explosive. This makes optimum use of the internal area of the container, without any remaining cavities.

In its simplest form, a container according to Claim 17 for an explosive apparatus according to the invention has an internal area whose dimensions depend on the edge lengths of the molding. The internal area has a square outline with a side length which corresponds at least approximately to the longest edge length of the molding, and has a height which corresponds at least approximately to the shortest edge length of the molding, or to an integer multiple of it. This allows numerous arrangements of the moldings in the internal area, as has already been described above. Furthermore, this ensures that a firing means, for example an explosive capsule, can be inserted into a firing hole in one of the moldings through the aperture hole to the internal area, which is aligned with one of the firing holes in one of the moldings, thus allowing the detonation of the explosive apparatus to be initiated. The internal area of the container is virtually completely filled by the moldings. On firing, the compact and fixed arrangement of the moldings ensures that the detonation is transmitted to all the moldings, and the full charge intensity is therefore produced. The container is a component of the explosive apparatus having a function in every stage, that is to say from the storage through transportation to actual use, of the explosive.

A molding according to Claim 18 for an explosive apparatus according to the invention is cuboid and contains explosive. Furthermore, there is at least one firing hole, and preferably a plurality of them, in the molding. The edge lengths of the molding are predetermined to the extent that they have a ratio of 1:2:4. Compliance with this edge length ratio is critical since the dimensions of the internal area of the container depend on it.

A kit according to Claim 19 for an explosive apparatus according to the invention contains a basic module and at least one additional module. The modular design allows the strength of the explosive charge to be varied within wide limits, and therefore to be matched to the intended target.

BRIEF DESCRIPTION OF THE DRAWINGS

The explosive apparatus according to the invention will be explained in more detail in the following text with reference to one exemplary embodiment, which is illustrated in the drawings and in which, purely schematically.

DETAILED DESCRIPTION OF EMBODIMENTS

Figure 1:
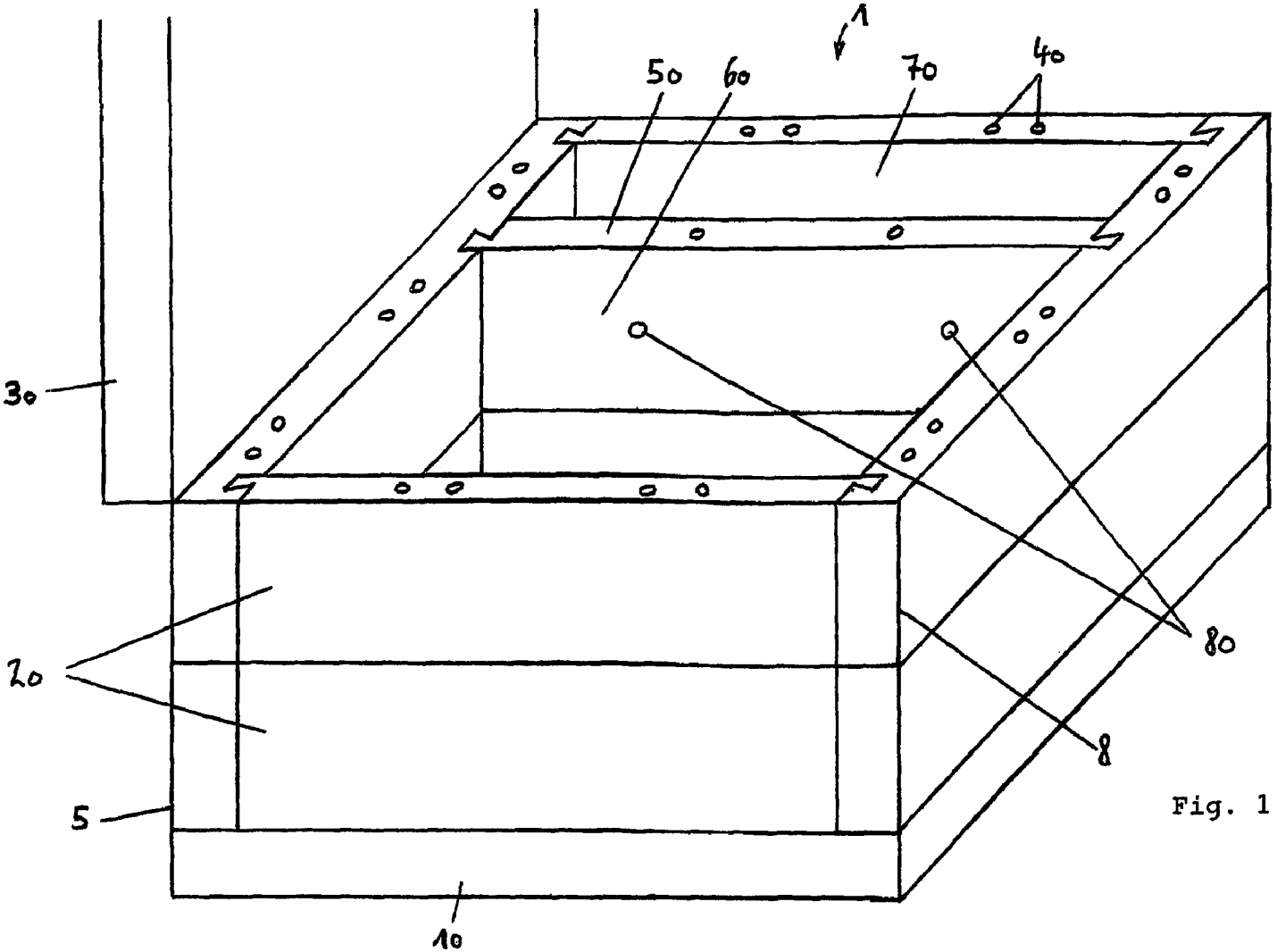
FIG. 1 shows a perspective view of one embodiment of a container with an open cover.
Figure 5:
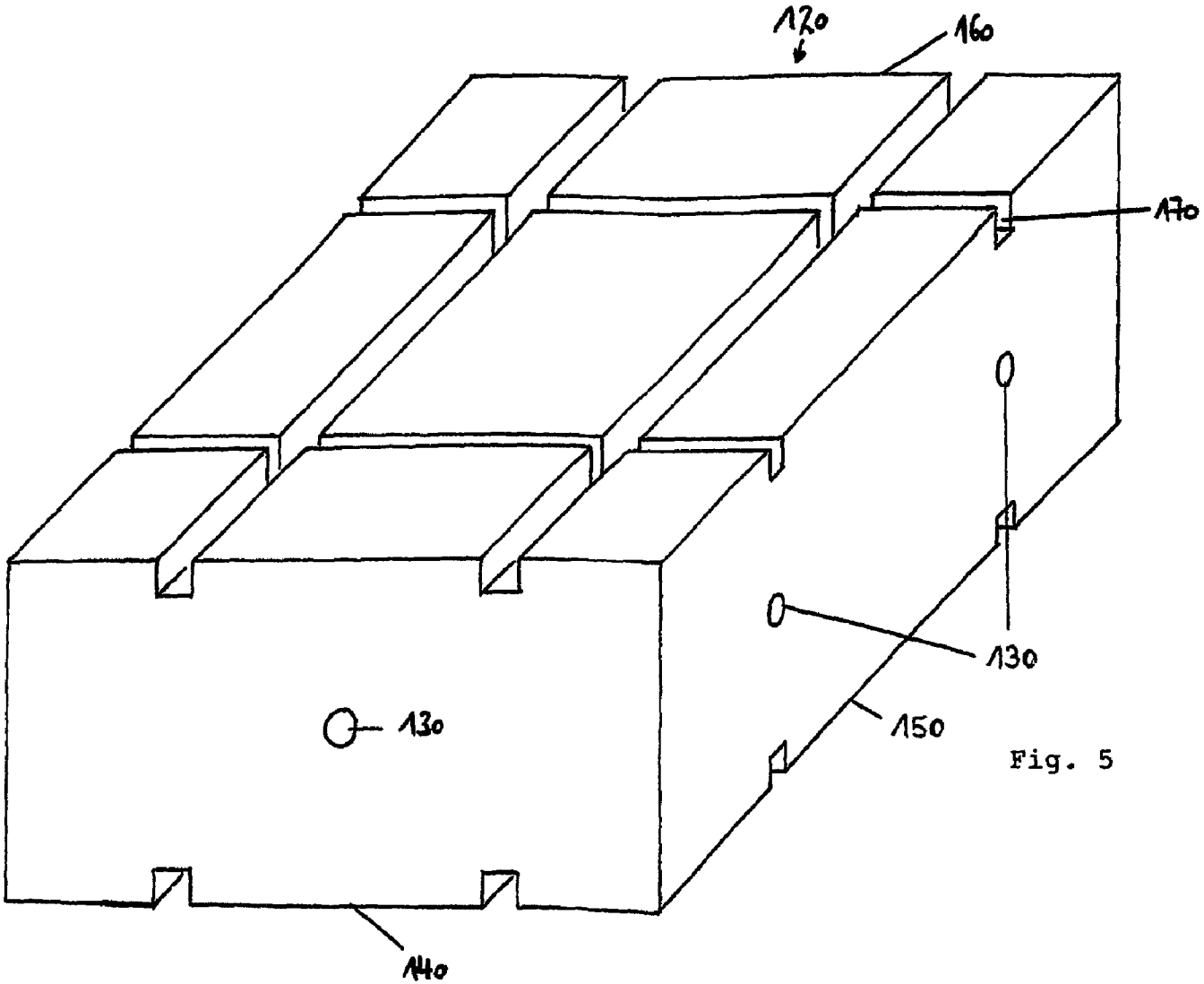
FIG. 5 shows a perspective view of one embodiment of a cuboid molding, containing explosive.

FIG. 1 shows a container 1 according to the invention with a rectangular bottom wall 10, side walls 20 and an open cover wall 30. The illustrated container 1 comprises a basic module 5 and an additional module 8. The height of the side walls 20 of the basic module 5 and of the side walls 20 of the additional module 8 corresponds to the shortest edge length of the molding 120. The basic module has a bottom wall 10, and side walls 20. The additional module has side walls 20, with the cover wall 30, which is part of the basic module, being attached to the additional module. The side walls 20 have threaded holes 40 through them and are preferably screwed tight against the bottom wall 10 by means of screws. An intermediate wall 50 separates an internal area 60, which is intended to accommodate moldings 120 as shown in FIG. 5 and as described further below, from a service area 70. The intermediate wall 50 also has aperture holes 80 through which an explosive capsule can be inserted from the service area 70. The cover wall 30 is articulated on the rear side wall 20 by means of two hinges 110.

Figure 2:
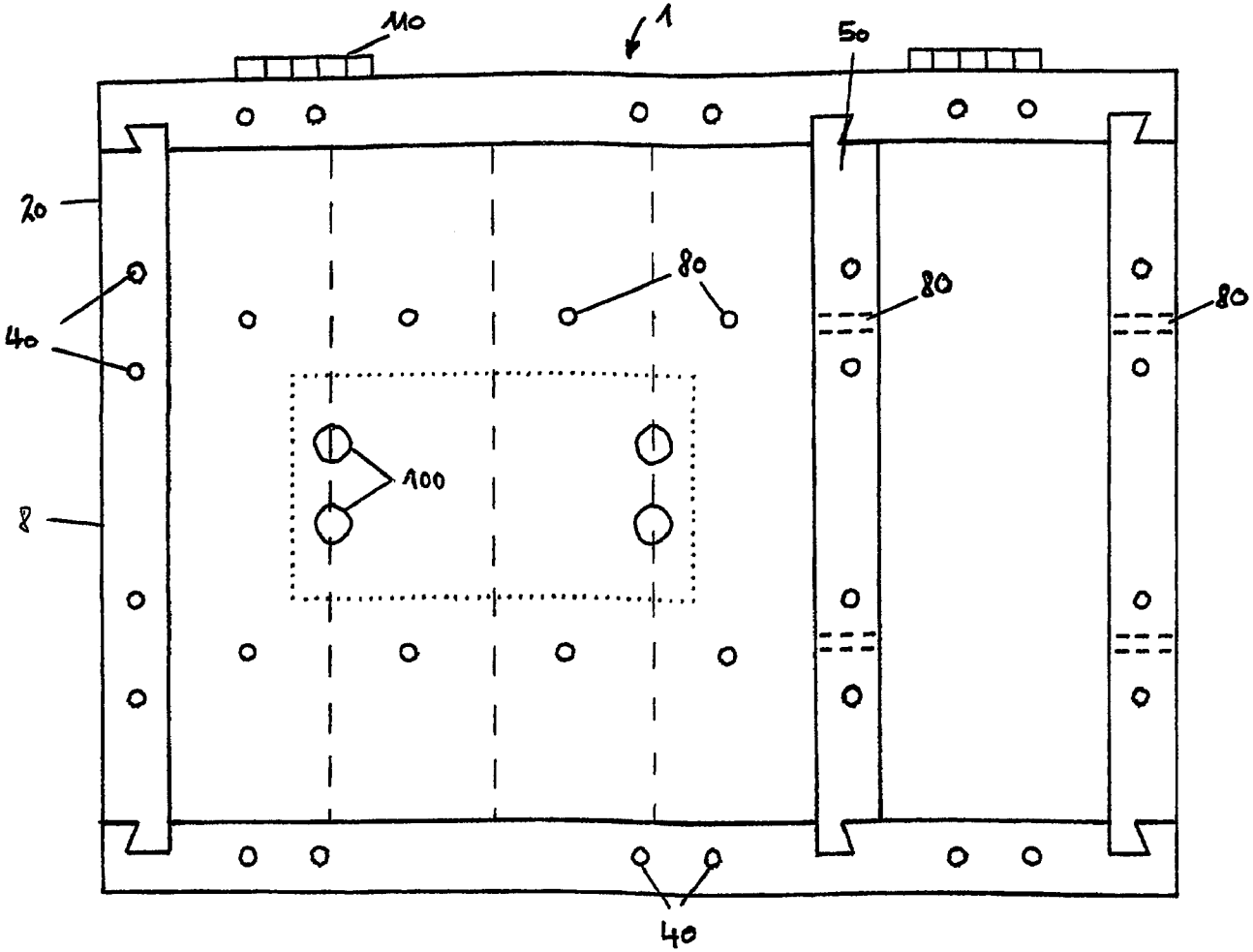
FIG. 2 shows a plan elevation of the container shown in FIG. 1.

FIG. 2 shows the plan elevation of the container 1 shown in FIG. 1. Four moldings 120 are likewise shown indicatively, and are placed in the internal area 60 with a square outline. In the present embodiment, both the bottom wall 10, the intermediate wall 50 and the side wall 20 which bounds the service area 70 have aperture holes 80. The side walls 20 are preferably attached to the bottom wall 10 by means of screws through the threaded holes 40 which are provided for this purpose. The arrangement of the aperture holes 80 in the bottom wall 20 and in the intermediate wall 50 is chosen such that the firing holes 130 which are arranged in the molding 120 can be made coincident with the aperture holes 80. An attachment plate 90, which is illustrated only in an indicative form here, for a telescopic support is likewise fitted to the bottom wall 10, and the telescopic support has a jointed head which is preferably attached by means of screws through the threaded holes 100 that are provided for this purpose. The cover wall 30 is attached to the rear side wall 20 by means of two hinges 110. The corner connections of the side walls 20 are in the form of dovetail joints. This allows the side walls 20 to be plugged together without the use of further attachment means, for example screws. Furthermore, this type of connection can be made very easily. Other types of connection may also be chosen.

Figure 3:
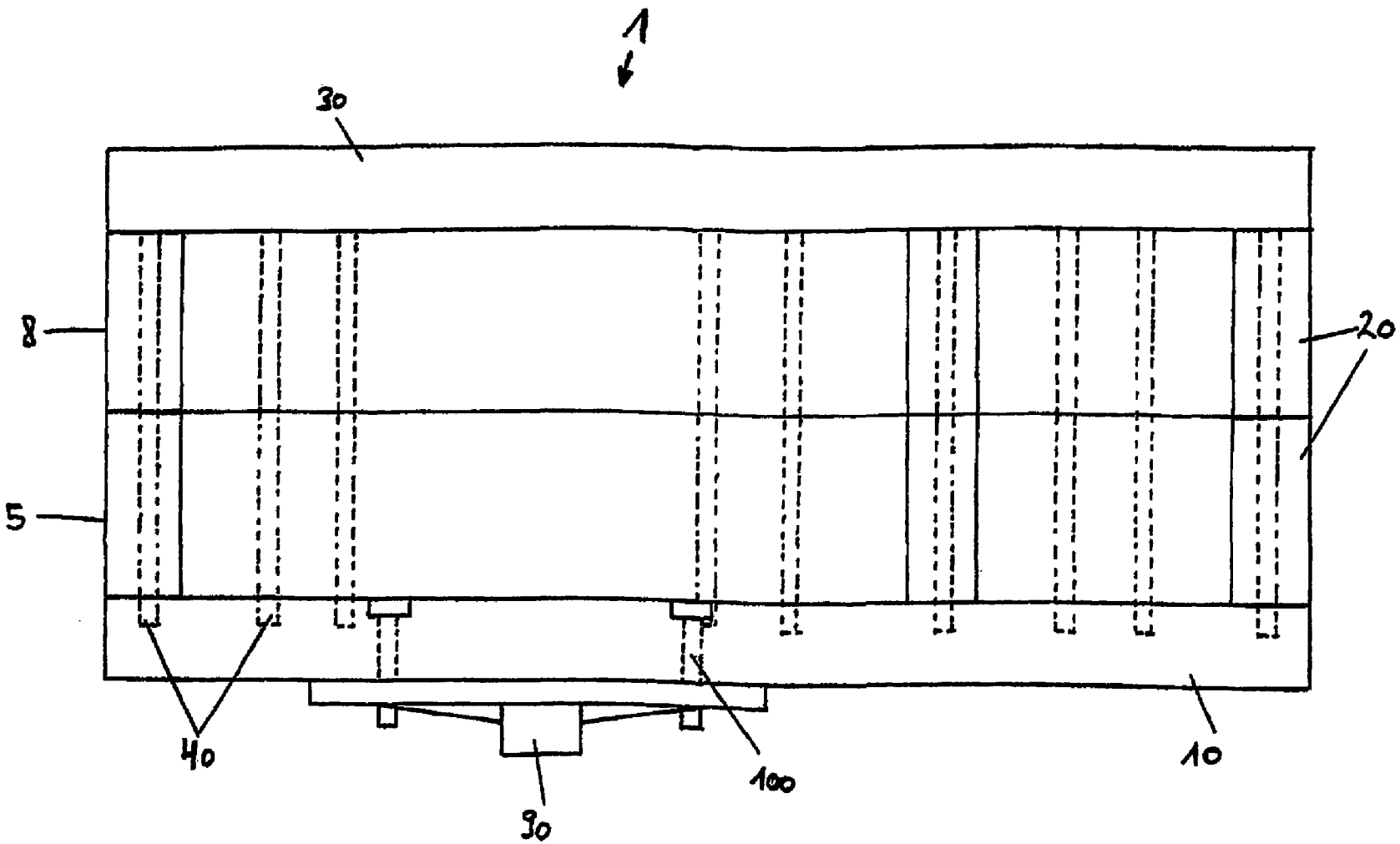
FIG. 3 shows the container as shown in FIG. 1, in a view with the cover wall in the closed position.

FIG. 3 shows a view of the container 1 shown in FIG. 1, with the cover wall in the closed position. This shows the side walls 20, the bottom wall 10 with the attachment plate 90, and the cover wall 30 in the closed position. The figure indicatively shows the threaded holes 40 which are used for attachment of the side walls 20, and the threaded holes 100 which are used to fit the attachment plate 90. The figure does not show the internal area 60 in which the moldings 120 are placed, or the service area 70, which is separated by the intermediate wall 50. Said service area 70 is used to accommodate all the other accessories for the explosive apparatus. These accessories include the telescopic support with the jointed head, all the firing means, for example explosive capsules, detonation cords, tools etc. In the embodiment shown here, the attachment plate 90 for the telescopic support has already been attached to the bottom wall 10 by means of the threaded holes 100 provides for this purpose. If the attachment plate 90 is not used, then it is stowed together with the other accessories in the service area 70. The threaded holes 40 in the side walls 20 and the intermediate wall 50 are illustrated only indicatively.

Figure 4:
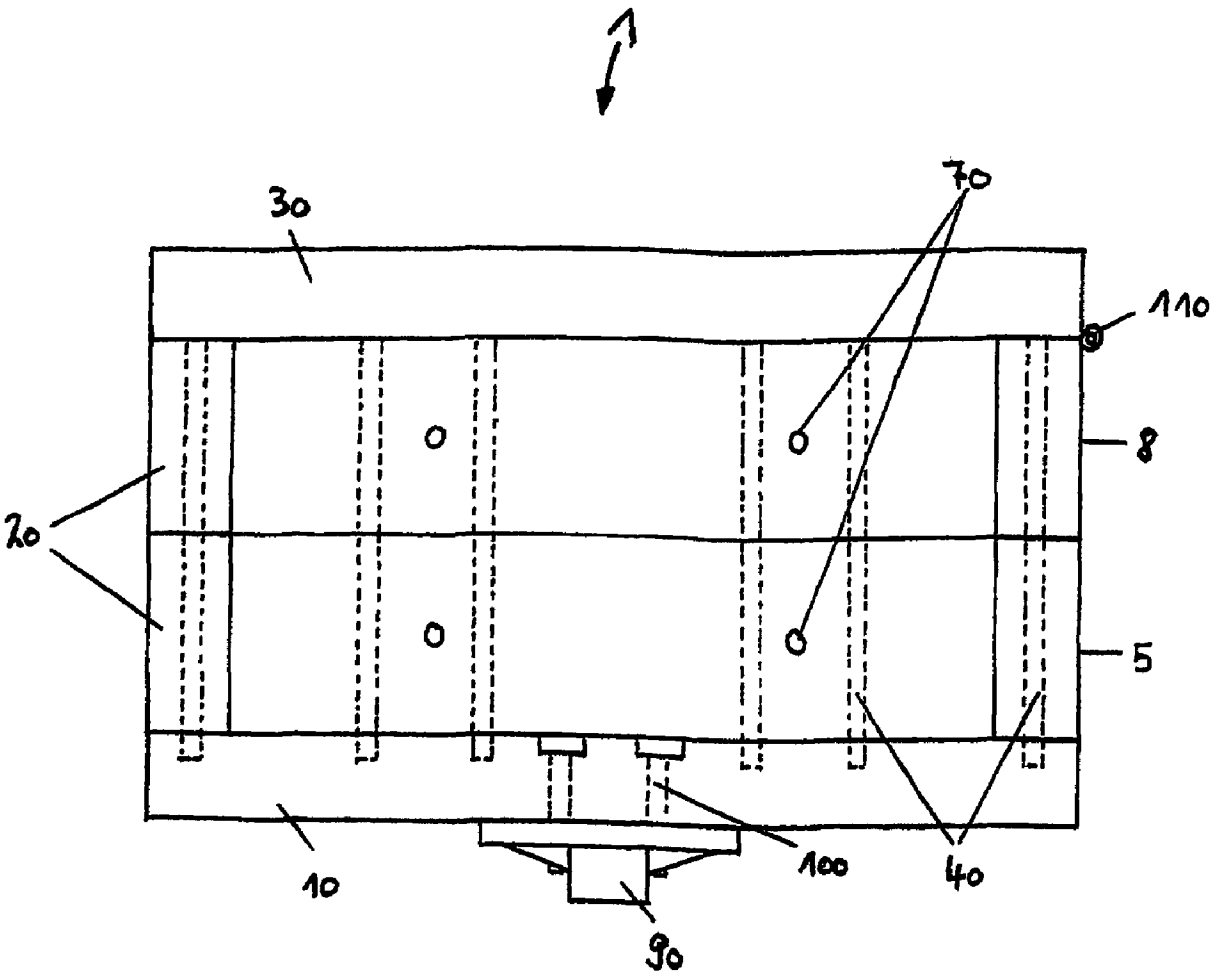
FIG. 4 shows a side view of the container shown in FIG. 1.

FIG. 4 shows a side view of the container 1 according to the invention as shown in FIG. 1, having a bottom wall 10, side walls 20 and a cover wall 30. The side walls 20 have threaded holes 40 through them by means of which they are attached to the bottom wall 10, preferably by means of screws. The side wall 20 also has aperture holes 70. An attachment plate 90 for the telescopic support with the jointed head is likewise fitted to the bottom plate 10. The cover wall 30 is attached to the rear side wall 20 by means of two hinges 110.

FIG. 5 shows a cuboid molding 120 according to the invention and containing explosive, whose edge lengths, for example 6 cm, 12 cm and 24 cm, have a ratio of 1:2:4, in the form of a perspective illustration.

The dimensions of the molding 120, which are quoted by way of example, result in the internal area 60 of the container 1 having an outline of 24 cm by 24 cm, and a height of 6 cm. In the illustrated example, the additional module has a height of 6 cm. This results in the internal area 60 having an overall height of 12 cm.

Firing holes 130 can be seen well. In the present embodiment, the two parallel sides with the edge length ratio of 1:2 140 have a firing hole 130 which, for example, is arranged at a distance of 6 cm from the shorter edge and at a distance of 3 cm from the longer edge, at the centre of that side. The two parallel sides with the edge length ratio 1:4 150 have two firing holes 130; by way of example, these are each arranged at a distance of 3 cm from the longer edges and at a distance of 6 cm from the shorter edge. The firing holes which can be seen in this figure do not pass all the way through. They only have to be able to accommodate the firing means that is normally used, for example detonation cords or explosive capsules. However, embodiments are also feasible in which these firing holes pass all the way through. The four firing holes on each of the two parallel sides with the edge length ratio of 2:4 160 cannot be seen. These firing holes are, for example, at a distance of 3 cm from the longer edge, and are at a distance of 6 cm from the shorter edges. They are therefore arranged accurately at the intersections of the depressions, which are in the form of grooves.

The two parallel sides with the edge length ratio of 2:4 160 have depressions 170, which are in the form of grooves, in the illustrated embodiment 4, and these depressions 170 run in pairs parallel to edges of the molding 120, thus resulting in a grid-like pattern. Various cross sections are feasible for the depressions 170 which are in the form of grooves. The illustrated depressions 170 which are in the form of grooves and have a square cross section, for example with a side length of 6 mm, are particularly preferable. It is also preferable for the depressions 170 which are in the form of grooves to run parallel to edges of the molding 120. As can easily be seen, other arrangements of the depressions which are in the form of grooves are also feasible.

Figure 6B:
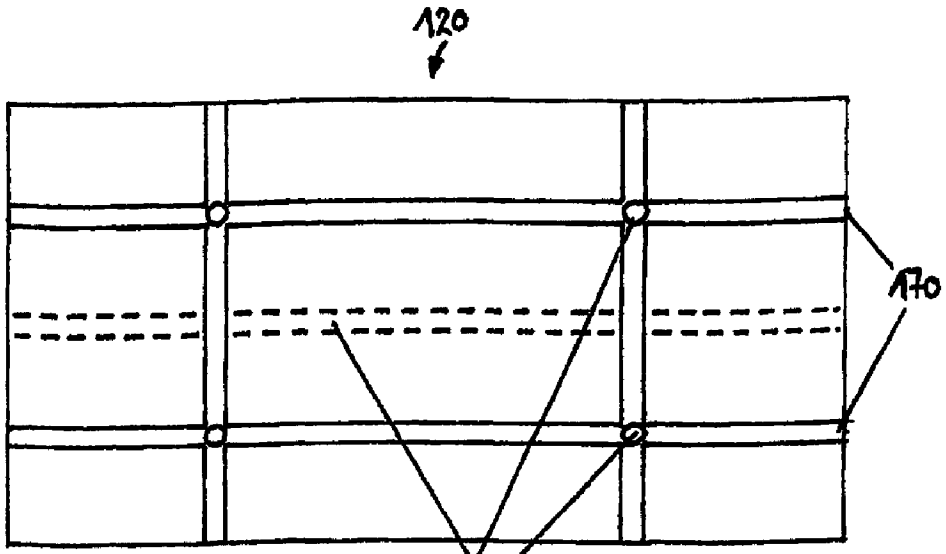
FIG. 6*b* shows a plan elevation of the molding shown in FIG. 5.
Figure 6A:
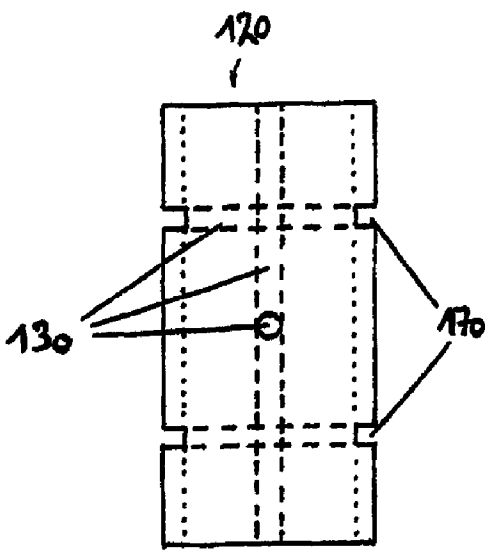
FIG. 6*a* shows an end elevation of the molding shown in FIG. 5.

FIG. 6*a* shows the end elevation of the molding 120 illustrated in perspective form in FIG. 5. This figure shows the depressions 170, which are in the form of grooves, with the particularly preferred square cross section. The figure likewise shows the firing hole 130 arranged at the centre of the side. The firing holes 130 on the other sides of the cuboid molding 120 are illustrated only indicatively.

FIG. 6*b* shows the plan elevation of the molding 120 illustrated in perspective form in FIG. 5. The illustration shows the four firing holes 130 on one of the two parallel sides with the edge length ratio of 2:4 160. These four firing holes 130 pass all the way through and, in the present embodiment, are arranged at the intersections of the depressions 170, which are in the form of grooves.

Figure 6C:
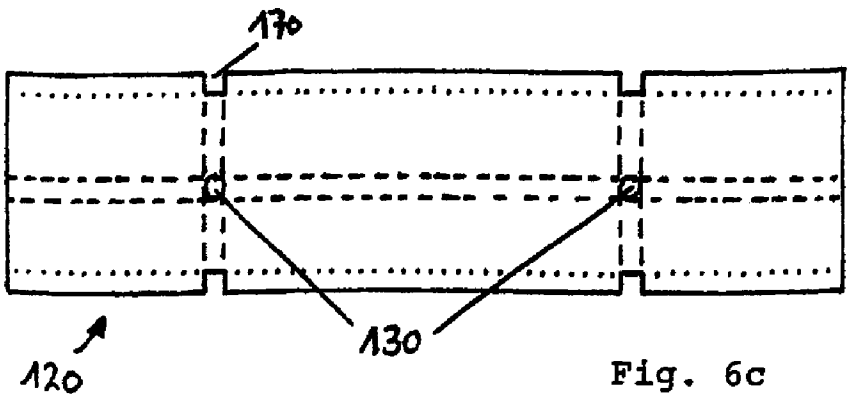
FIG. 6*c* shows a side elevation of the molding shown in FIG. 5.

FIG. 6*c* shows the side elevation of the molding 120, which is illustrated in perspective form in FIG. 5. The firing holes 130 in the side with the edge length ratio of 1:4 150 and some of the depressions 170 which are in the form of grooves can be seen well. The firing holes 130 in the other sides of the molding 120 are shown only indicatively.

Figure 7:
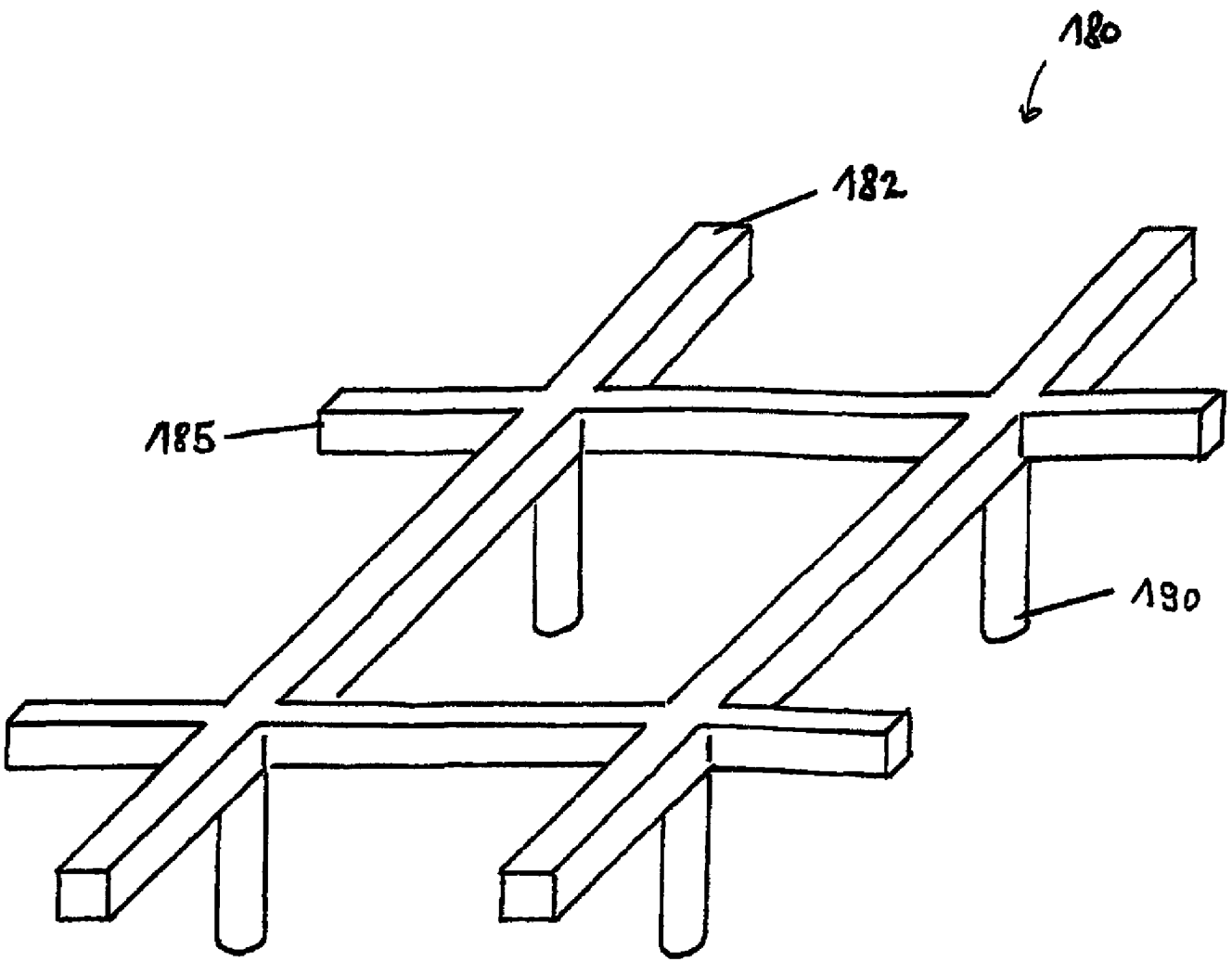
FIG. 7 shows a perspective view of one embodiment of an insert which is intended for insertion into depressions, which are in the form of grooves, in one of the moldings.
Figures 8A, 8B, 8C:
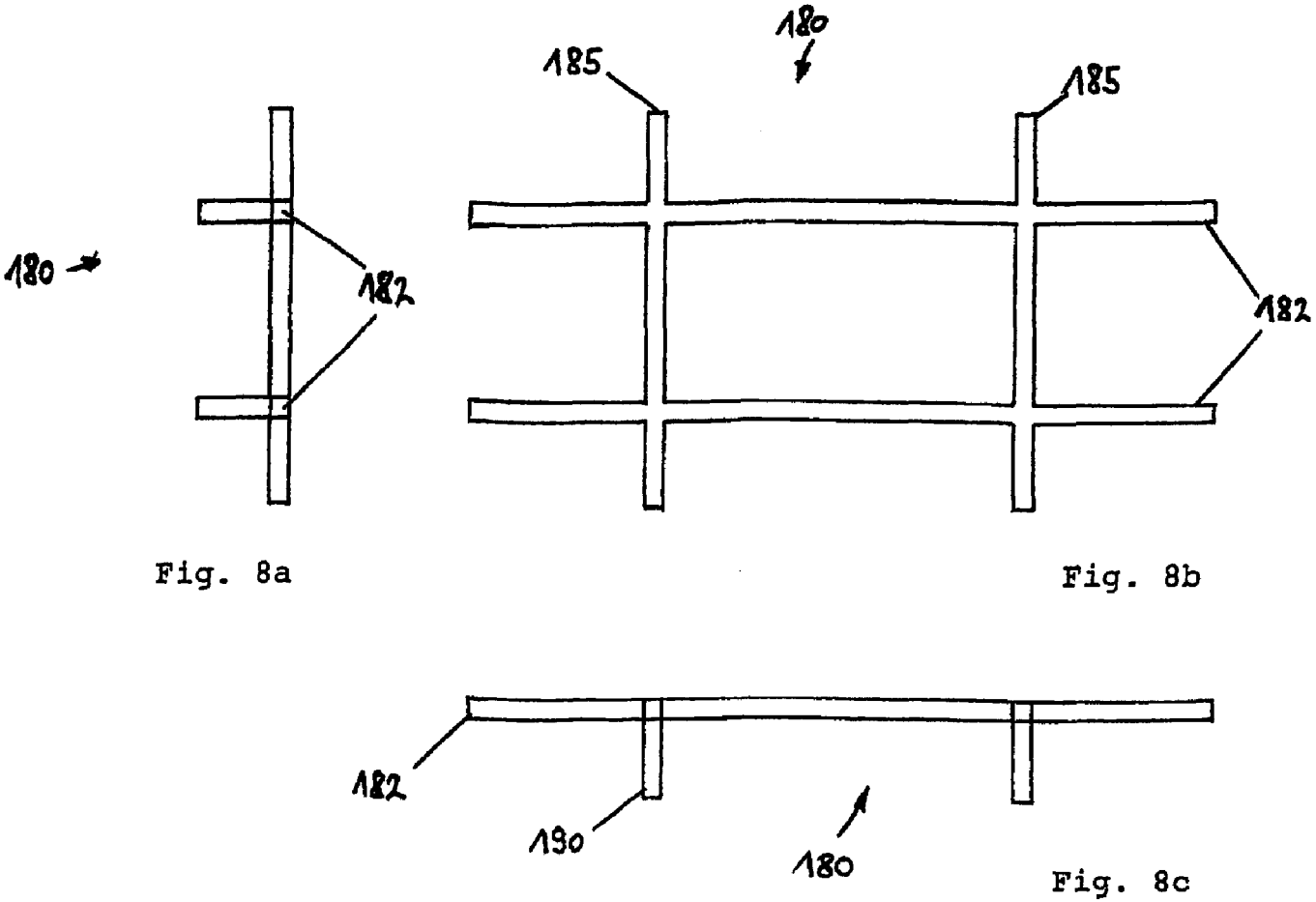
FIG. 8*a* shows an end elevation of the insert shown in FIG. 7.
FIG. 8*b* shows a plan elevation of the insert shown in FIG. 7.
FIG. 8*c* shows a side elevation of the insert shown in FIG. 7.

FIG. 7 shows a perspective view of an insert 180, which fits the depressions 170 in the form of grooves in the molding 120, from FIGS. 8*a* to 8*c*. The insert 180 has elements 182 and 185 which are arranged at right angles to one another and are in the form of rods. This results in a grid-like pattern. The elements 182 and 185 in the form of rods have a particularly preferred square cross section. The cylindrical pins 190, which are arranged at right angles to the other insert 180, fit into the firing holes 130 in the two parallel sides with the edge length ratio of 2:4 160. The pins 190 result in optimum use of the space existing in the internal area 60, thus directly resulting in an optimized explosive effect. The insert 180 with the elements 182 and 185 in the form of rods has a height, together with the pins 190, which corresponds to half the shortest edge length of the molding 120. Inserts 180 can therefore be used on both parallel sides with the edge length ratio of 2:4 160 of a molding 120.

The insert 180 may contain various materials. Fragmentation inserts may be produced from metal. Most metals are suitable for this purpose, and tungsten and iron are preferable. Tungsten has a high density and is also a very hard metal. On detonation of the explosive apparatus, corresponding fragments are generated by means of weak points which are provided in the insert 180. This can be used, for example, against armoured vehicles in the military field. In other embodiments, the insert 180 contains an incendiary means, for example in the form of aluminium powder. Inserts 180 are also possible that contain the same explosive, or possibly a different explosive, as the molding 120. Inserts 180 such as these which contain explosive can be used to make optimum use of the space in the internal area 60.

Figure 9:
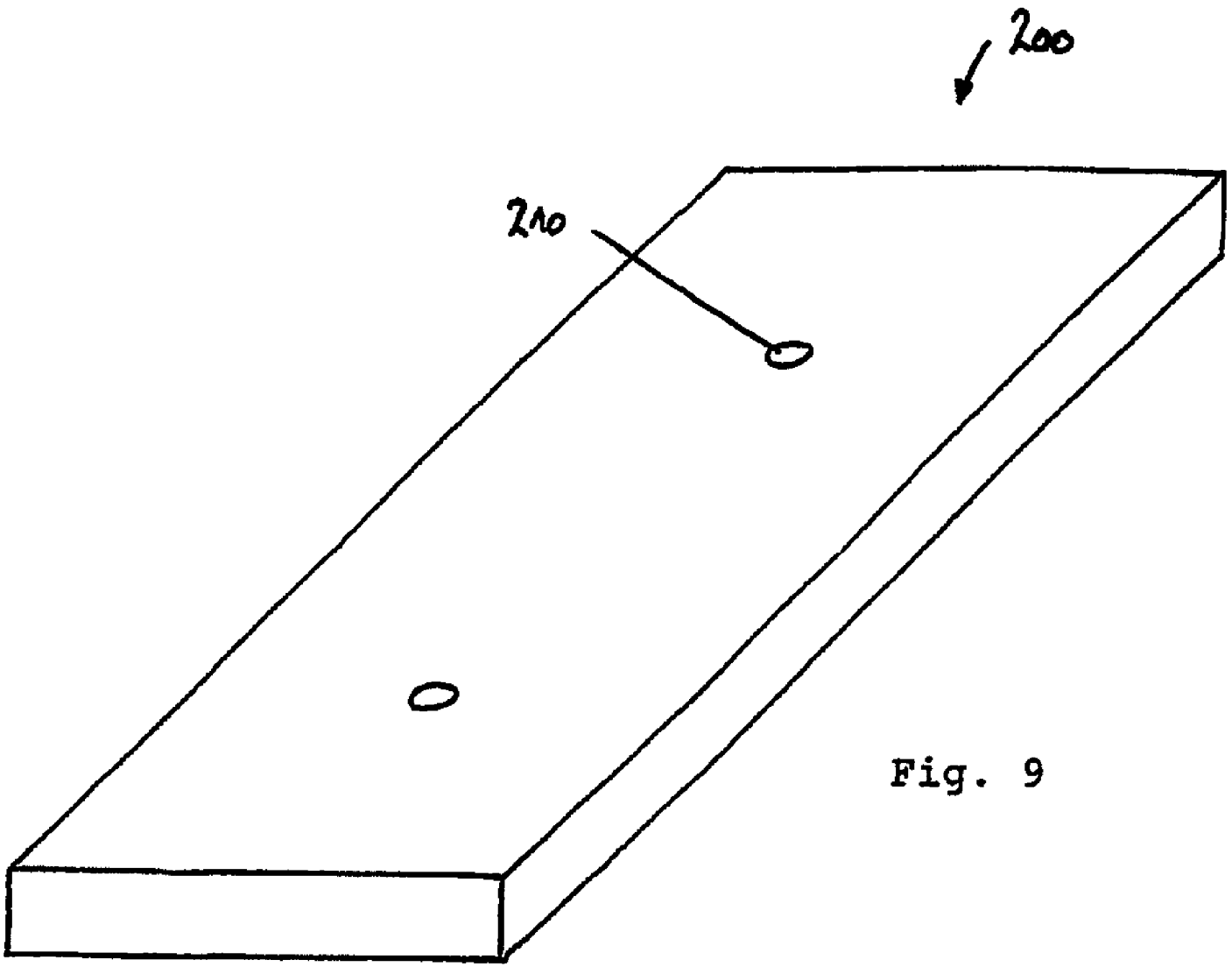
FIG. 9 shows a perspective view of a steel plate in order to produce a directional charge.
Figure 10B:
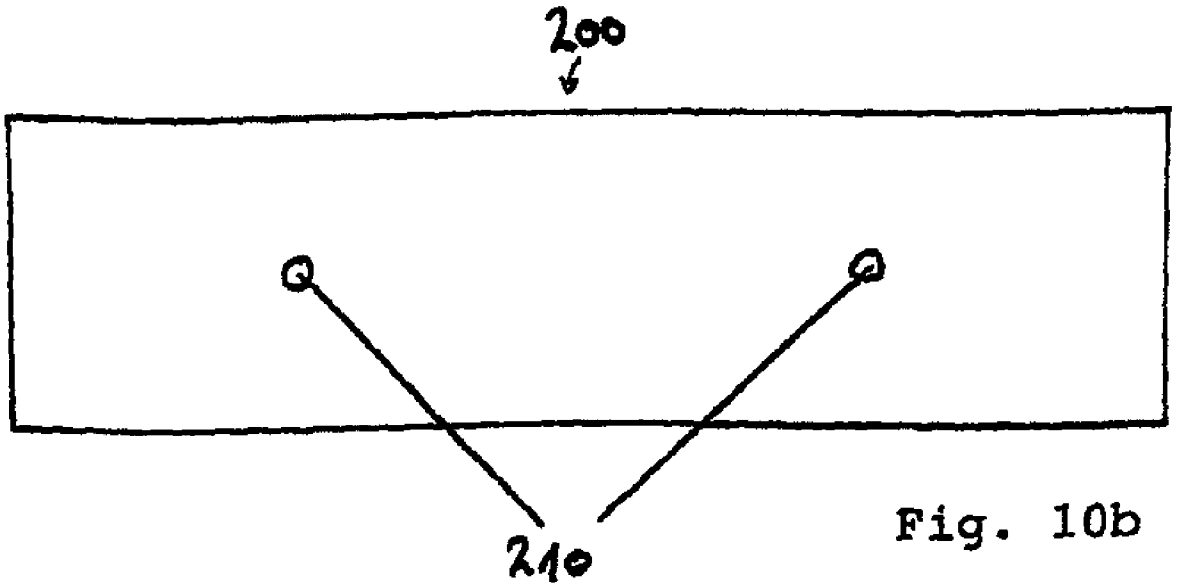
FIG. 10*b* shows a plan elevation of the steel plate shown in FIG. 9.
Figure 10C:
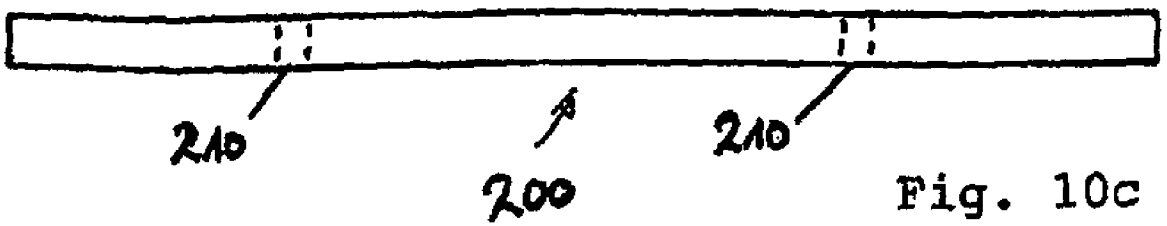
FIG. 10*c* shows a side elevation of the steel plate shown in FIG. 9.
Figure 10A:
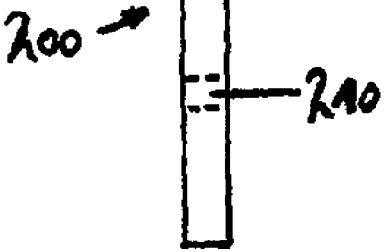
FIG. 10*a* shows an end elevation of the steel plate shown in FIG. 9.

FIG. 9 shows a perspective view of a metal plate 200 from FIGS. 10*a*, 10*b* and 10*c*. The metal plate 200 preferably contains iron and is used to achieve a directional charge. It may also contain other metals. The metal plate 200 has an edge length ratio of 1:4 and can preferably be fitted to the corresponding side of a molding 120 by means of screws through the threaded holes 210. Since the moldings 120 at least approximately fill the internal area 60, one of the moldings must be dispensed with when using metal plates 200 such as these. Another possible way to create the required space in the internal area 60 is to use an additional module, as well as the basic module. This space which remains in the internal area 60 must be filled with fillers, for example sand, in order to ensure that the moldings 120 are firmly seated.

In addition to the illustrated example, other embodiments are also feasible. In one simpler embodiment, the container 1 for the explosive apparatus according to the invention does not have a service area 70. In one preferred embodiment, the basic module 5 has an internal area 60 whose height corresponds to twice the shortest edge length of the molding 120.

The invention claimed is:

1. An explosive apparatus comprising:

at least two cuboid moldings, each of which includes at least one firing hole and explosive, and whose edge lengths have a ratio of substantially 1:2:4; and a container including an internal area having a square outline and at least one aperture hole to the internal area, the internal area having a side length which corresponds at least approximately to a longest edge length of the molding and a height which corresponds at least approximately to a shortest edge length of the molding or to an integer multiple thereof, wherein the moldings are placed in the internal area of the container such that at least one firing hole in one of at least two moldings is aligned with at least one aperture hole in the container, at least one aperture hole being intended for insertion of an explosive capsule into at least one firing hole of the corresponding molding.

2. The explosive apparatus according to claim 1, wherein the aperture hole is arranged in a bottom wall of the container.

3. The explosive apparatus according to claim 1, wherein the container additionally has a service area which is separated from the internal area by an intermediate wall.

4. The explosive apparatus according to claim 3, wherein the intermediate wall and a side wall, which bound the service area of the container, have at least one aperture hole, respectively, wherein the aperture hole in the intermediate wall is intended to be aligned with the firing hole in one of the moldings.

5. The explosive apparatus according to claim 1, wherein at least one aperture hole comprises a plurality of aperture holes.

6. The explosive apparatus according to claim 5, wherein the aperture holes in the container are sealed by a detachable closure element.

7. The explosive apparatus according to claim 6, wherein the closure element is configured to be a part of a wall which forms the container, and is connected via a weak point to a remaining part of the corresponding wall such that the closure element is separable.

8. The explosive apparatus according to claim 1, wherein the container is designed in a modular form and has a basic module and at least one additional module, wherein the basic module has a bottom wall, four side walls whose height corresponds to the shortest edge length, or to twice the shortest edge length of the molding, and a cover wall, and wherein the additional module has four side walls whose height corresponds to the shortest edge length or to twice the shortest edge length of the molding.

9. The explosive apparatus according to claim 1, wherein the moldings have at least one firing hole on all sides.

10. The explosive apparatus according to claim 9, wherein the moldings have the firing hole on two parallel sides when the edge length ratio is 1:2, have two of the firing holes on the two parallel sides when the edge length ratio is 1:4, and have four of the firing holes on the two parallel sides when the edge length ratio is 2:4.

11. The explosive apparatus according to claim 1, wherein the moldings have at least one depression in a form of a groove on at least one side, in order to hold an insert that is a fragmentation or incendiary insert.

12. The explosive apparatus according to claim 11, wherein an insert is arranged such that the insert fits into the depressions in the molding, each of the depressions being in the form of the groove.

13. The insert according to claim 12, wherein the insert contains one of metal, incendiary means or explosive.

14. The explosive apparatus according to claim 11, wherein the moldings have at least two of the depressions which are in a form of a groove and are arranged parallel to edges of the molding, respectively.

15. The explosive apparatus according to claim 1, wherein the moldings have a first color on two parallel sides when the edge length ratio is 1:2, have a second color on the two parallel sides when the edge length ratio is 1:4, and have a third color on the two parallel sides when the edge length ratio is 2:4.

16. The explosive apparatus according to claim 1, wherein the container has an attachment plate for a telescopic support.

17. The container of the explosive apparatus according to claim 1, wherein the container has at least one aperture hole to the internal area having the square outline, the internal area having the side length corresponding at least approximately to the longest edge length of the molding and the height corresponding at least approximately to the shortest edge length of the molding or to an integer multiple thereof, wherein the container comprises a material selected from the group consisting of wood, metal and plastics.

18. The molding for the explosive apparatus according to claim 1, wherein the molding is cuboid, contains explosive, and has at least one firing hole, and the edge lengths of the molding have the ratio of substantially 1:2:4, wherein the molding has at least one depression in a form of a groove on at least one side and wherein the groove has a rectangular cross section.

19. A kit for the explosive apparatus according to Claim 1 having a basic module and at least one additional module.

* * * * *